US007077395B2

(12) United States Patent
Ata et al.

(10) Patent No.: US 7,077,395 B2
(45) Date of Patent: Jul. 18, 2006

(54) SHEET AFTER-TREATMENT DEVICE AND IMAGE FORMING APPARATUS EQUIPPED WITH THE DEVICE

(75) Inventors: Hironobu Ata, Shizuoka (JP); Yasuyoshi Hayakawa, Shizuoka (JP); Takashi Kuwata, Shizuoka (JP); Kenichiro Isobe, Shizuoka (JP); Masayoshi Fukatsu, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 190 days.

(21) Appl. No.: 10/429,786

(22) Filed: May 6, 2003

(65) Prior Publication Data

US 2003/0215276 A1 Nov. 20, 2003

(30) Foreign Application Priority Data

May 15, 2002 (JP) ..... 2002-140363

(51) Int. Cl.
*B05H 37/04* (2006.01)

(52) U.S. Cl. ..... 270/58.08; 399/410; 227/155

(58) Field of Classification Search ..... 270/58.08; 227/140, 154, 155; 399/410
See application file for complete search history.

(56) References Cited

U.S. PATENT DOCUMENTS

| | | | | | |
|---|---|---|---|---|---|
| 4,762,312 | A | * | 8/1988 | Ushirogata | 270/58.14 |
| 5,282,611 | A | * | 2/1994 | Ueda et al. | 270/58.09 |
| 5,709,376 | A | * | 1/1998 | Ushirogata | 270/58.11 |
| 6,223,965 | B1 | * | 5/2001 | Nakatsuka | 227/111 |

FOREIGN PATENT DOCUMENTS

| | | | |
|---|---|---|---|
| JP | 8-192951 | | 7/1996 |
| JP | 09194121 | A * | 7/1997 |
| JP | 09278270 | A * | 10/1997 |
| JP | 2001-31323 | | 2/2001 |
| JP | 2002-80162 | | 3/2002 |

* cited by examiner

*Primary Examiner*—Patrick Mackey
(74) *Attorney, Agent, or Firm*—Fitzpatrick, Cella, Harper & Scinto

(57) ABSTRACT

A sheet after-treatment device equipped with a stapler main body which staples sheets fed between upper and lower jaws in an opened state with a staple by closing the upper and lower jaws, and a holder for holding the stapler main body, in which a sheet transport guide surface of an upstream-side portion of the holder and the lower jaw of the stapler main body are arranged in the area where the sheets are transported, and the sheet transport guide surface of the upstream-side portion of the stapler main body is situated above the lower jaw.

24 Claims, 11 Drawing Sheets

SHEET AFTER-TREATMENT DEVICE AND IMAGE FORMING APPARATUS EQUIPPED WITH THE DEVICE

BACKGROUND OF THE INVENTION

1. Field of the Invention

The present invention relates to a sheet after-treatment device for performing after-treatment on sheets and to an image forming apparatus equipped with the sheet after-treatment device as a component. In particular, the present invention relates to a sheet after-treatment device allowing a reduction in size without impairing sheet transport and to an image forming apparatus equipped with such a device.

2. Related Background Art

Conventionally, a sheet after-treatment device is provided, for example, in the main body of an image forming apparatus as one of the components of the image forming apparatus, to perform after-treatment on a sheet with an image formed thereon transported from the apparatus main body. The image forming apparatus, which forms an image on a sheet, may consist of a copying machine, a printer, a facsimile apparatus, or a multifunction apparatus consisting of a combination of such apparatuses. The sheet, on which an image is to be formed, may consist of an ordinary paper sheet, a thin sheet of resin which is an ordinary paper substitute, a cardboard, a postcard, a sealed letter, a sheet for an overhead projector or the like.

Conventionally, a sheet after-treatment device provided in the main body of an image forming apparatus aligns the end portions of a plurality of sheets which have undergone image formation (printing) and performs an after-treatment such as stapling.

FIG. 10 shows an example of the construction of a sheet after-treatment device. This sheet after-treatment device, designated by a numeral reference 1000, is equipped with a discharge roller pair 1003 constituting a sheet discharge outlet, an intermediate stacking surface 1002 on which the discharged sheets are stacked together, a stapler 1001 arranged on the opposite side with respect to the sheet transport direction indicated by the arrow E, etc. The sheets discharged from the discharge roller pair 1003 are stacked on the intermediate stacking surface 1002, and undergo switch-back transport in the direction indicated by the arrow F toward an opening 1001*a* of the stapler 1001. Then, while their ends in the direction intersecting the sheet transport direction (i.e., the width direction) and their ends in the sheet transport direction are being aligned, the sheets are introduced into the opening 1001*a*. Then, the stack of sheets SB is stapled by the stapler 1001 before being discharged to the left as seen in FIG. 10.

FIGS. 11A through 11C show another example of the construction of a sheet after-treatment device. As shown in FIG. 11A, in this sheet after-treatment device, designated by a reference numeral 1010, a stapler 1011 is arranged off the sheet transport path so that it may not obstruct the transport of sheets in the direction indicated by the arrow Q.

In the former type of conventional sheet after-treatment device 1000, shown in FIG. 10, in which the sheets, once transported in the direction of the arrow E, are transported backwards in the direction of the arrow F, it is necessary for the intermediate stacking surface 1002 and the stapler 1001 to be arranged at a position one step lower than the discharge roller pair 1003. Accordingly, the sheet after-treatment device 1000 requires extra space in the vertical direction, which leads to a rather large height, resulting in a rather large device size.

In the latter type of conventional sheet after-treatment device 1010, it is necessary to once abut the sheets, which have been transported in the direction of the arrow J (FIG. 11B), against a surface on the opposite side with respect to the sheet transport direction in order to effect alignment in the sheet transport direction. Further, it is necessary to move the sheets from the sheet transport path to the opening of the stapler 1011 as indicated by the arrow G (FIGS. 11A to 11C). Thus, a wide intermediate stacking portion is required, so that the size of the device as a whole becomes rather large. In this case, the stapled sheets are transported in the direction of the arrow Q.

Further, in those conventional sheet after-treatment devices 1000 and 1010, ineffective staples generated as a result of mis-stapling or the like of the staplers 1001 and 1011 can fall to cause short-circuiting in the electrical components. In view of this, it is necessary to provide in the vicinity of the stapler 1001, 1011 a recovery tray for recovering the ineffective staples. However, the provision of the recovery tray requires extra space, resulting in an increase in the general size of the device and in cost.

SUMMARY OF THE INVENTION

It is an object of the present invention to provide a sheet after-treatment device allowing a reduction in size without impairing sheet transport.

Another object of the present invention is to provide a sheet after-treatment device capable of recovering ineffective staples without involving any substantial increase in space.

Still another object of the present invention is to provide an image forming apparatus whose main body is equipped with a sheet after-treatment device as mentioned above.

To attain the above objects, according to the present invention, there is provided a sheet after-treatment device including: stapling means for stapling sheets fed between upper and lower jaws in an opened state with a staple by closing the upper and lower jaws; and holding means for holding the stapling means, in which an upper end of an upstream-side portion of the holding means and the lower jaw of the stapling means are arranged in an area where the sheets are transported, and the upper end of the upstream-side portion of the holding means is situated above the lower jaw.

In the sheet after-treatment device of the present invention, there is further provided sheet alignment means for aligning the sheet ends in a direction intersecting the sheet transport direction to effect positioning of the sheets at a sheet stapling position.

In the sheet after-treatment device of the present invention, the staple is projected from the lower jaw, which is stationary, and the upper jaw moves toward and away from the lower jaw to bend the staple.

In the sheet after-treatment device of the present invention, there is further provided a sheet guide portion for guiding sheets on the upstream side of the holding means, and the sheet guide portion, the upstream-side portion of the holding means, and the lower jaw are arranged such that the following are ranked in height as follows in descending order: the sheet guide portion, the upper end of the upstream-side portion of the holding means, and the lower jaw.

In the sheet after-treatment device of the present invention, there is further provided a sheet guide portion for guiding sheets on the upstream side of the holding means, and the sheet guide portion, the upstream-side portion of the holding means, the lower jaw, and the downstream-side portion of the holding means are arranged such that the following are ranked in height as follows in descending order: the sheet guide portion, the upper end of the upstream side portion of the holding means, the lower jaw, and the upper end of the downstream-side portion of the holding means.

In the sheet after-treatment device of the present invention, the upper end of the upstream-side portion of the holding means constitutes a guide surface for guiding the sheets that are fed.

In the sheet after-treatment device of the present invention, a region formed by an upstream-side portion of the holding means and the upper surface of the lower jaw constitutes a staple storage portion for storing staples resulting from mis-stapling of the sheets.

In the sheet after-treatment device of the present invention, between the stapling means and the upstream side of the holding means and between the stapling means and the downstream side of the holding means, a gap for accommodating ineffective staples generated as a result of mis-stapling of sheets is provided at least between the stapling means and the upstream side of the holding means.

In the sheet after-treatment device of the present invention, there is further provided on the upstream side of the holding means a gap for accommodating staples resulting from mis-stapling of the sheets.

In the sheet after-treatment device of the present invention, the gap has an inclined staple guide surface for guiding staples resulting from mis-stapling of the sheets.

In the sheet after-treatment device of the present invention, the stapling means and the holding means are inclined such that they are lower on the upstream side with respect to the sheet transport direction.

In the sheet after-treatment device of the present invention, the stapling means and the holding means are provided so as to be capable of displacement so that the opening of the upper and lower jaws may be exposed.

In the sheet after-treatment device of the present invention, the stapling means and the holding means are provided so as to be rotatable from the downstream side to the upstream side with respect to the sheet transport direction so that the opening of the upper and lower jaws may be exposed.

To attain the aforementioned objects, according to the present invention, there is provided an image forming apparatus including: image forming means for forming images on sheets; and a sheet after-treatment device for stapling the sheets with the images formed thereon, in which the sheet after-treatment device is one as described above.

In the sheet after-treatment device of the present invention, it is possible to arrange the opening of the stapler unit 208 in the sheet transport area, thereby making it possible to achieve a reduction in size and cost.

In the sheet after-treatment device of the present invention, ineffective staples generated as a result of mis-stapling or malfunction of the stapler are recovered to make it possible to avoid the danger of short-circuiting in the electrical components.

The image forming apparatus of the present invention, which is equipped with a sheet after-treatment device allowing a reduction in size and cost, can be produced in a small size and at low cost.

In the image forming apparatus of the present invention, which is equipped with the above-described sheet after-treatment device capable of avoiding the danger of short-circuiting in the electrical components, it is possible to prevent damage to the device.

BRIEF DESCRIPTION OF THE DRAWINGS

FIGS. 5A, 5B, 5C and 5D are diagrams showing the positional relationship between the transport area for the sheet being transported and the stapler unit in the sheet after-treatment device of the first embodiment of the present invention, of which:

FIG. 5A shows the sheet as being transported in the sheet transport area in the direction of the arrow M;

FIG. 5B shows the sheet as having passed the opening of the stapler main body;

FIG. 5C shows how the sheet is transported reversely in the direction of the arrow N to abut a transport stopper; and FIG. 5D shows how the sheet stack is moved in the direction of the arrow R to be fed to the stapler unit;

FIGS. 11A, 11B and 11C are schematic plan views of another conventional sheet after-treatment device, of which:

FIG. 11A shows a sheet as fed in;

FIG. 11B shows the sheet as reversely transported; and

FIG. 11C shows the sheet as fed into the stapler.

DESCRIPTION OF THE PREFERRED EMBODIMENTS

A sheet after-treatment device according to an embodiment of the present invention and an image forming apparatus equipped with the device will now be described with reference to the drawings.

The sheet after-treatment device is provided, for example, in the main body of an image forming apparatus as a component of the image forming apparatus, and is adapted to perform after-treatment on a sheet with an image formed thereon transported from the apparatus main body. The image forming apparatus may consist of a copying machine, a printer, a facsimile apparatus, or a multifunction apparatus formed by combining these apparatuses. In this example, the sheet after-treatment device of this embodiment is provided, in a printer, typically a laser beam printer, as a component thereof. However, this should not be construed restrictively. It may also be provided in an apparatus other than a printer.

The sheet, on which an image is to be formed, may consist of an ordinary paper sheet, a thin sheet of resin which is an ordinary paper substitute, a cardboard, a postcard, a sealed letter, a sheet for an overhead projector or the like.

Printer

Figure 1:
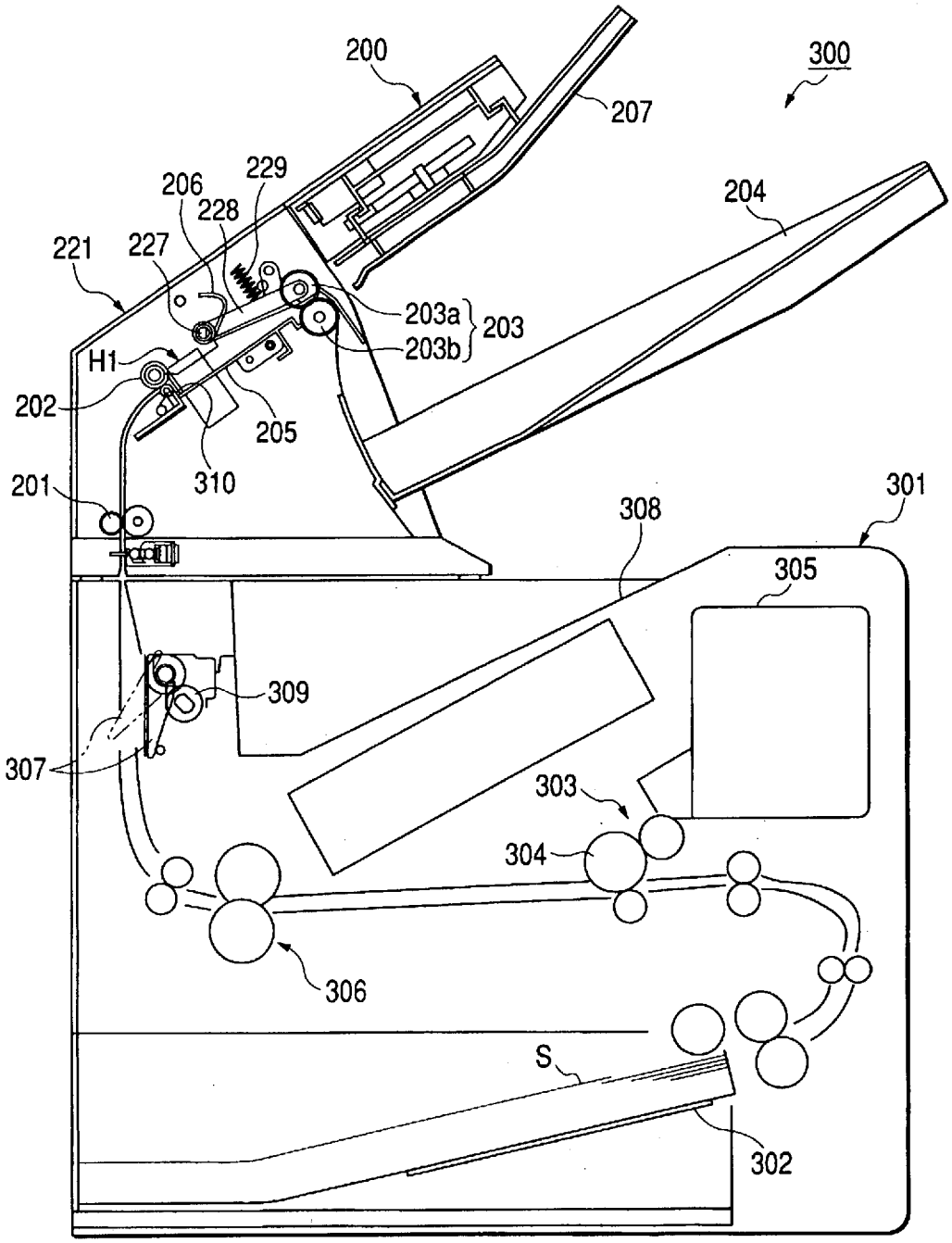
FIG. 1 is a sectional view of a printer constituting an image forming apparatus having a sheet after-treatment device according to a first embodiment of the present invention in the upper portion of the apparatus main body as one of the components thereof.

FIG. 1 shows a printer 300, whose main body 301 has in the upper portion thereof a sheet after-treatment device 200 according to the first embodiment as one of the components of the printer 300. Instead of the sheet after-treatment device 200 of the first embodiment, the printer may also be equipped with a sheet after-treatment device according to another embodiment.

In the printer 300, its main body 301 is connected by itself to a computer or a network such as LAN, and, on the basis of image information, print signals etc. supplied from the computer, network or the like, an image is formed (printed) on a sheet by a predetermined image formation process before discharging the sheet. This printer 300 may also be equipped with a reading portion for reading originals, in which case an image of an original is copied on a sheet on the basis of reading information supplied from the reading portion before the sheet is discharged. The printer main body 301 and the sheet after-treatment device 200 are electrically connected to each other by a cable connector (not shown).

A plurality of sheets S are stacked in a feeding cassette 302 provided in the lower portion of the printer main body 301. The plurality of sheets S are fed one by one, starting with the uppermost one, to an image forming portion 303 constituting the image forming means. In the image forming portion 303 of the printer main body 301, an toner image is formed by a so-called laser beam image forming process on the basis of predetermined print signals supplied from the computer, network or the like, and the toner image thus formed is transferred to the upper surface of a sheet S fed from the feeding cassette 302. Note that when the sheet is fed into the image forming portion 303, the toner image has already been formed on a photosensitive drum 304 of the image forming portion 303 using toner in a cartridge 305.

Subsequently, heat and pressure are applied to the sheet by a fixing device 306 on the downstream side, whereby the toner image is permanently fixed to the sheet. The sheet S to which the image has been fixed is discharged either to a face-down discharge portion 308 provided in the upper portion of the printer main body 301 or to a stacking tray 204 of the sheet after-treatment device 200 according to the position of a flapper 307 of the printer 301, which is switched based on a control signal from a control portion (not shown).

As shown in FIG. 1, the sheet is guided by the flapper 307 switched to the position indicated by the broken line. The sheet is turned back in a substantially U-shaped sheet transport path leading to a discharge roller pair 309. As a result, the image surface is reversed, and the sheet is discharged face down from the printer main body 301 to the face-down discharge portion 308 by the discharge roller pair 309, with the toner image facing down.

Sheet After-Treatment Device of the First Embodiment

The sheet after-treatment device 200 receives the sheet discharged to the exterior from the printer main body 301, and treats the sheet in a simple stacking mode or an after-treatment mode.

When the simple stacking mode is selected for the sheet after-treatment device 200, the sheet is transported by an inlet roller pair 201, an intermediate roller pair 202, and a discharge roller pair 203 and placed on a stacking tray 204.

When the after-treatment mode is selected for the sheet after-treatment device 200, upper and lower rollers 203*a* and 203*b* of the discharge roller pair 203 are spaced apart from each other, and a plurality of sheets are passed over a stopper 310 by the inlet roller pair 201 and the intermediate roller pair 202 and temporarily stacked on an intermediate stacking portion 205. The sheet after-treatment device 200 causes a transport direction alignment paddle 206 to rotate clockwise from the position as shown in FIG. 1 to reversely transport the sheet stack on the intermediate stacking portion 205 until it abuts a stopper 310 for end regulation in the sheet transport direction. At the same time, alignment in the direction intersecting the sheet transport direction (sheet width direction) is effected by a sheet alignment means, for example, a lateral alignment means 207. Thereafter, the sheet after-treatment device 200 performs stapling by means of a stapler unit H1, and the rollers of the discharge roller pair 203 are brought into press contact with each other again to discharge the sheet stack onto the stacking tray 204. The paddle 206 rotates around a shaft 227, which is equipped with a lever 228 at the forward end of which the upper roller 203*a* is rotatably provided. The lever 228 is urged by a spring 229 to keep the upper roller 203*a* in press contact with the lower roller 203*b*.

Figure 3B:
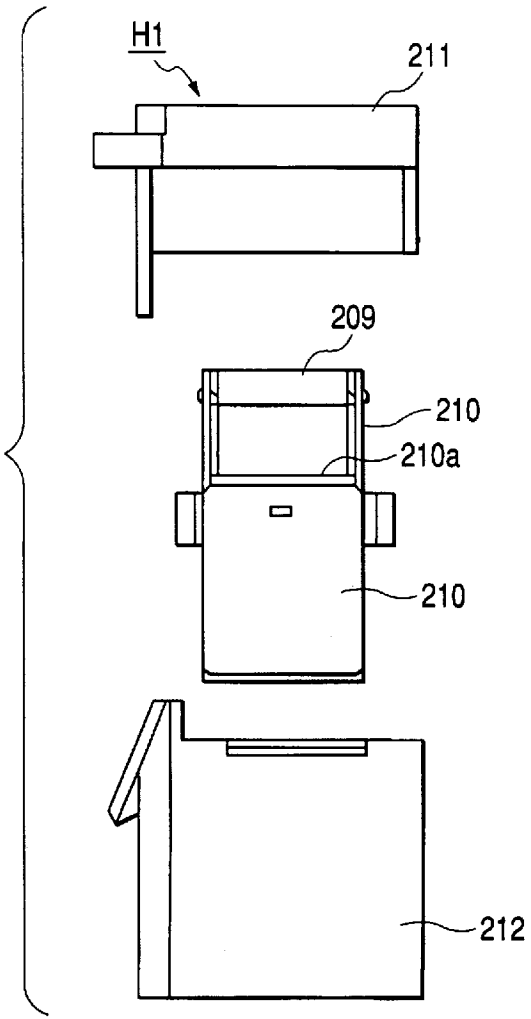
FIG. 3B is a right-hand side view of the stapler unit of FIG. 3A.
Figure 3A:
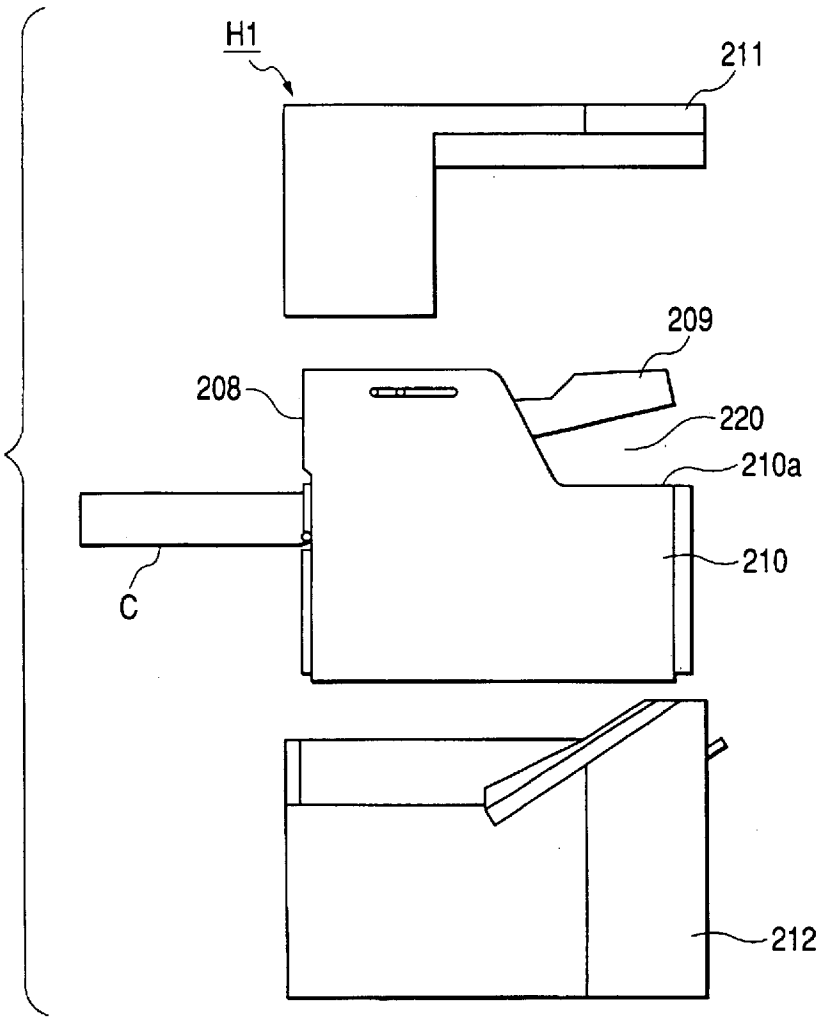
FIG. 3A is an exploded view of a stapler unit according to the first embodiment of the present invention.

FIGS. 3A and 3B are exploded views showing the construction of the stapler unit H1. The stapler unit H1 is equipped with a stapler main body 208, box-like holders 211 and 212, a staple cartridge C, etc. The stapler main body 208 is equipped with upper and lower jaws 209 and 210. When the upper and lower jaws 209 and 210 gape, an opening 220 is defined. In the stapler main body 208, a staple is projected from the stationary lower jaw 210 to penetrate the sheets introduced into the opening 220, and, at the same time, the upper jaw 209 is moved downwards to bend the staple, thereby stapling the sheet stack.

The holders 211 and 212 hold the stapler main body 208 from above and below to fix it to the main body 221 of the sheet after-treatment device 200. The staple cartridge C is detachable with respect to the stapler main body 208 and contains staples (not shown).

Figure 4B:
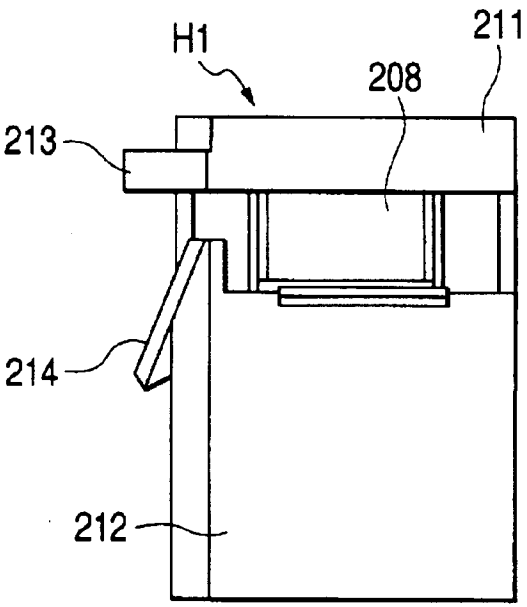
FIG. 4B is a right-hand side view of the stapler unit of FIG. 4A.
Figure 4A:
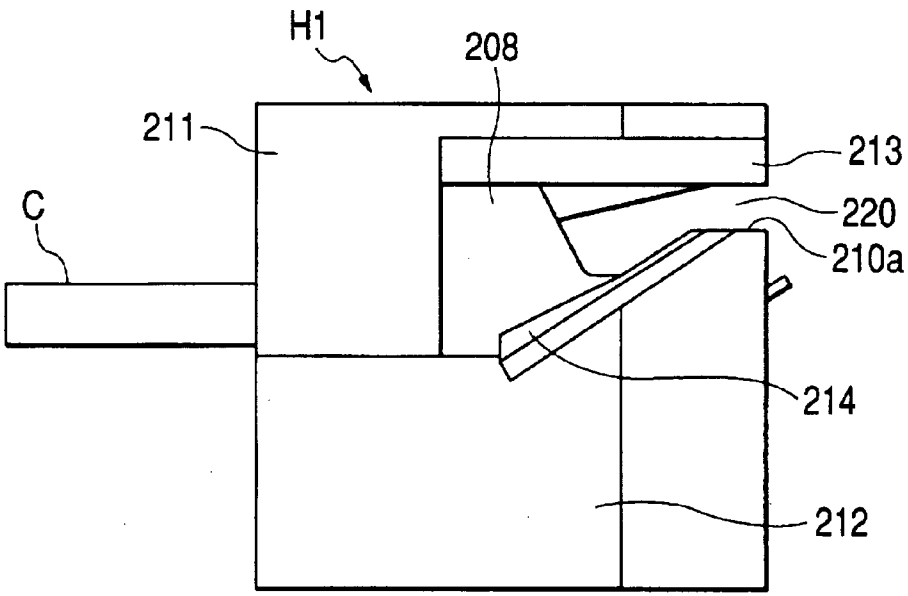
FIG. 4A is a diagram showing the stapler unit of the first embodiment of the present invention, in which a stapler main body and a holder are formed into an integral unit, as seen from the upstream side with respect to the sheet transport direction.

FIGS. 4A and 4B show the stapler unit H1 as formed by assembling the stapler main body 208 and the holders 211 and 212. Sheet transport guide surfaces 213 and 214 are formed integrally with the holders 211 and 212. The sheet transport guide surfaces 213 and 214 serve to guide the entering sheets S to the opening 220 of the stapler main body 208.

Figure 2:
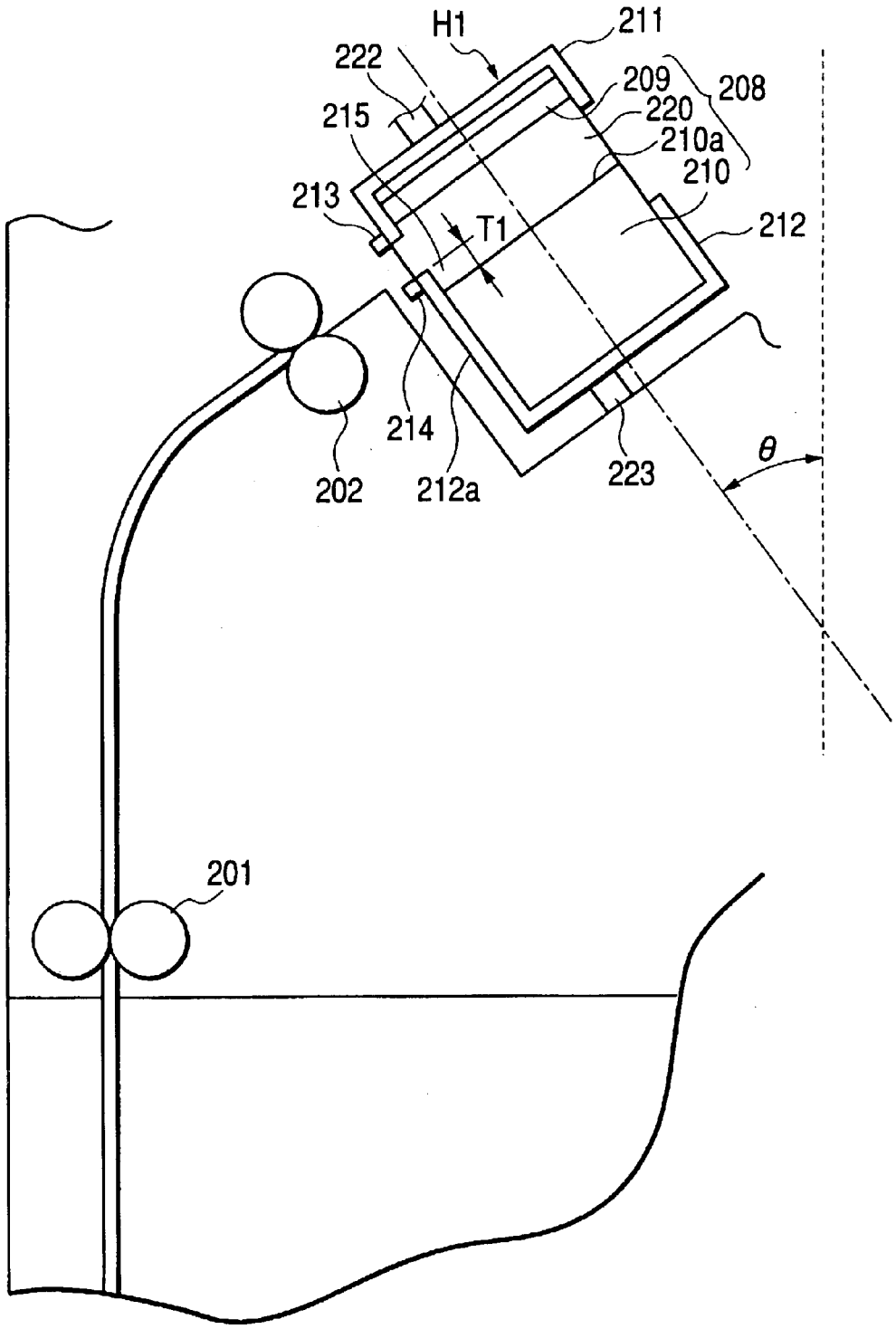
FIG. 2 is a schematic sectional view showing the general construction of the sheet after-treatment device of the first embodiment of the present invention.

FIG. 2 is a schematic diagram showing the construction of the stapler unit H1 and the periphery thereof. The stapler main body 208, held by the holders 211 and 212, is arranged so as to be inclined to the sheet-transport upstream side by an angle θ with respect to the vertical direction. That is, the stapler unit H1 is inclined such that it is lower on the upstream side with respect to the sheet transport direction.

The configuration of the lower holder 212 constituting the holding means is determined as follows. Assuming that (the height of the side wall 212*a* of the holder 212 on the sheet entrance side (the height of the sheet transport guide surface 214))−(the height of the upper surface 210*a* of the lower jaw 210 of the stapler main body 208)=T1, T1 is not less than 0. The dimension T1 substantially corresponds to the thickness of a staple. In FIG. 2, the step T1 is exaggerated for the purpose of clarity.

Due to this construction, there is defined inside the stapler unit H1, for example, a pocket portion 215 serving as a staple storage portion. This pocket portion 215 accommodates ineffective staples resulting from mis-stapling of sheets. Since the stapler unit H1 is inclined so as to be lower on the upstream side with respect to the sheet transport direction, the ineffective staples in the pocket portion 215 are gathered on one side, thus making it possible to remove the ineffective staples. Note that even if the stapler unit H1 is not inclined so as to be lower on the upstream side with respect to the sheet transport direction, it is possible to store ineffective staples in the pocket portion 215. By storing the ineffective staples in the pocket portion 215, it is possible to eliminate the danger of ineffective staples falling to cause short-circuiting in the electrical components.

FIGS. 5A, 5B, 5C, and 5D are plan views showing the positional relationship between the transport area SA for the sheet S being transported and the stapler unit H1. The opening 220 of the stapler unit H1 overlaps the transport area SA for the sheet S. That is, the sheet transport guide surface 214 at the upper end of the side wall 212*a* of the holder 212 on the sheet entrance side (See FIG. 2) and the upper surface 210*a* of the lower jaw 210 are situated in the sheet transport area SA.

Figure 5A:
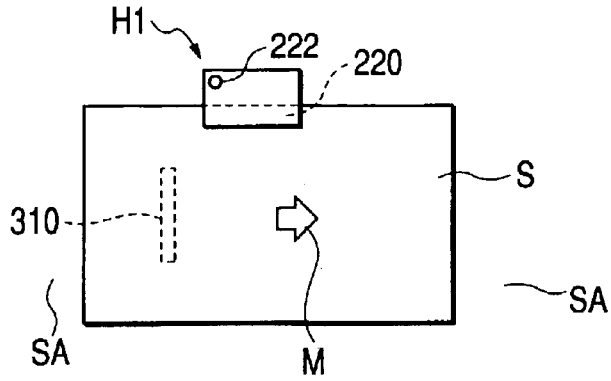
Figure 5B:
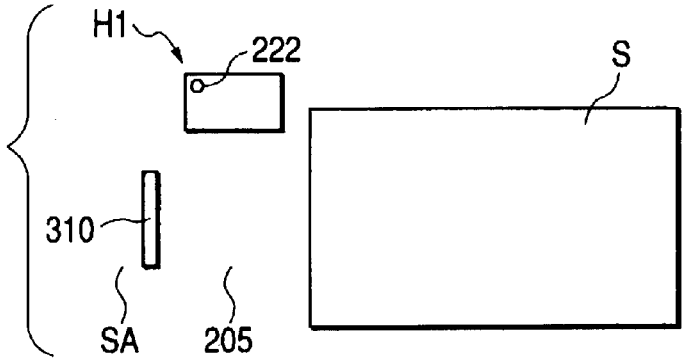
Figure 5C:
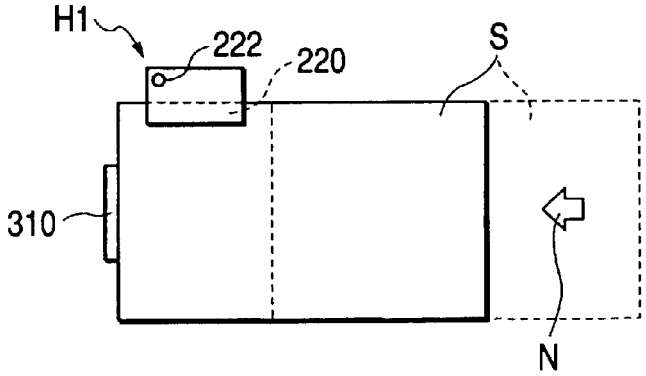

The sheet S transported in the sheet transport area SA in the direction of the arrow M as shown in FIG. 5A passes the opening 220 of the stapler main body 208, and is placed on the intermediate stacking portion 205, as shown in FIG. 5B. Thereafter, as shown in FIG. 5C, the sheet is transported reversely in the direction of the arrow N by the transport direction alignment paddle 206 to abut a transport stopper 310 (See FIG. 1). These operations are conducted each time a transported sheet arrives.

When the first sheet is transported reversely in the direction of the arrow N, the sheet passes the sheet transport guide surface 214 to abut the stopper 310. Since the intermediate stacking portion 205 is substantially flush with the sheet transport guide surface 214, there is no fear of the sheet being caught by the sheet transport guide surface 214. The sheets following the first one are transported reversely in the direction of the arrow N over the first sheet, so that there is no fear of these sheets being caught by the sheet transport guide surface 214.

Figure 5D:
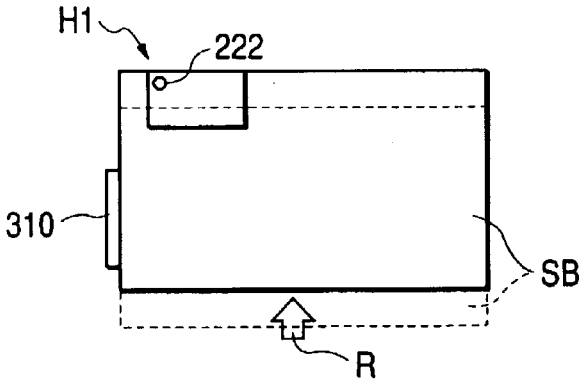

When a predetermined number of sheets S have been stacked on the intermediate stacking portion 205, the resultant sheet stack SB is moved in the direction of the arrow R to the sheet stapling position, as shown in FIG. 5D, while being aligned in width by the lateral alignment portion 207. And, at the sheet stapling position, the upper jaw 209 of the stapler main body 208 is lowered to staple the sheet stack by means of the upper and lower jaws 209 and 210.

Figure 11A:
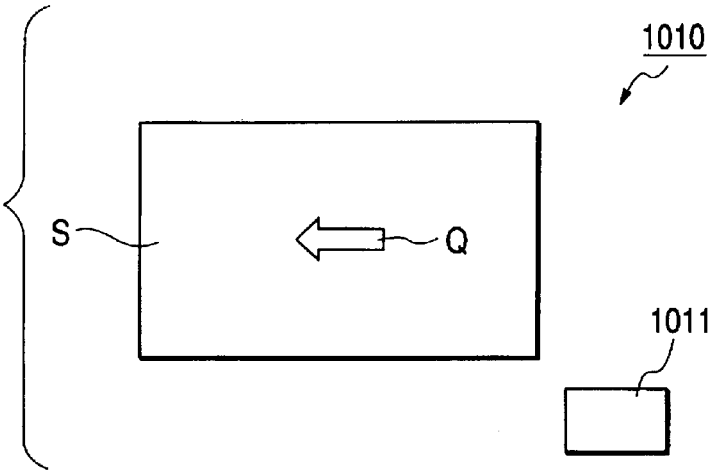
Figure 11B:
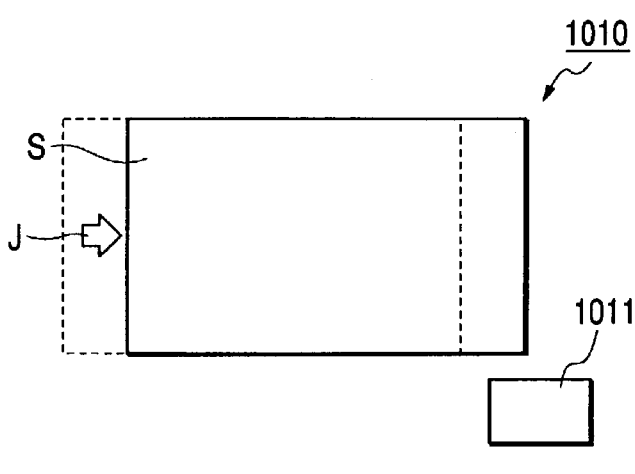
Figure 11C:
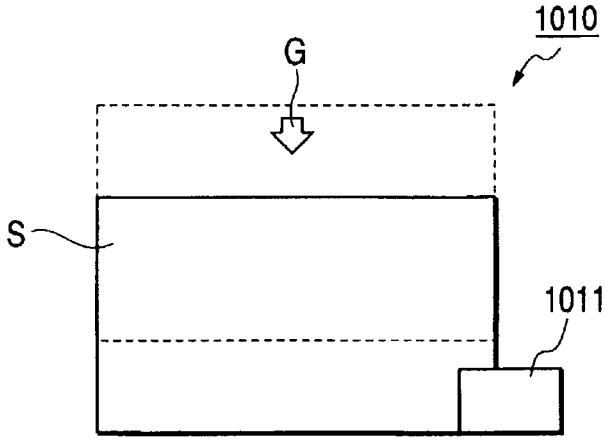

In the above operation, the distance through which the sheets move in the direction of the arrow R is shorter than the distance through which movement is made in the direction of the arrow G in the conventional example shown in FIG. 11C by a length in correspondence with the placing in advance of the sheets entering the opening 220 of the stapler as shown in FIG. 5C. Thus, it is possible to reduce the area of the intermediate stacking portion 205 by this difference in distance, making it possible to reduce the size of the sheet after-treatment device 200.

Further, while in the sheet after-treatment device 100 of this embodiment the sheet stack SB is stapled at the sheet stapling position after being moved in the direction of the arrow R as shown in FIG. 5D, it is also possible to staple the stack at the sheet stapling position without moving it in the direction of the arrow R. In that case, as shown in FIG. 5A, the sheets S are passed in the direction of the arrow M by the sheet stapling position. Thereafter, the sheets are moved in the direction of the arrow N to be stopped at the sheet stapling position, and aligned in width then and there by the lateral alignment portion 207 without being moved. Thus, in such an operation, as compared with the conventional example shown in FIGS. 11A to 11C, in which the sheets are moved in the direction of the arrow G, this embodiment allows a reduction in the area of the intermediate stacking portion 205 since it does not involve any movement in the direction of the arrow G, thus making it possible to reduce the size of the sheet after-treatment device.

Sheet After-Treatment Device of the Second Embodiment

Next, a sheet after-treatment device 250 according to the second embodiment will be described with reference to FIG. 6. Of the components of the sheet after-treatment device 250 of the second embodiment, the ones which are the same as those of the sheet after-treatment device 200 of the first embodiment are indicated by the same reference numerals, and a description of such components will be omitted. The sheet after-treatment device 250 of the second embodiment differs from the sheet after-treatment device 200 of the first embodiment in the configuration of box-like holders 251 and 252 of a stapler unit H2.

Figure 6:
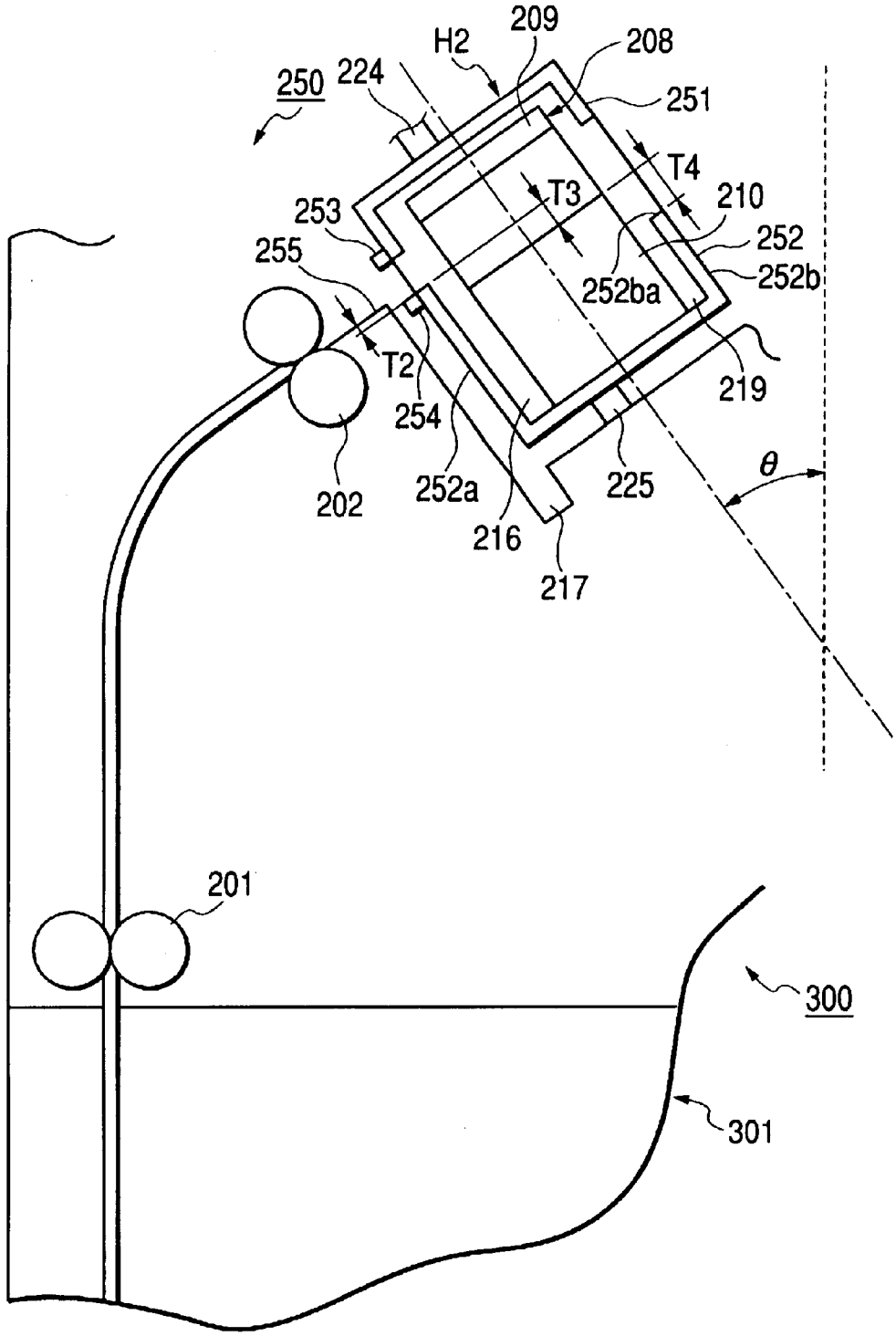
FIG. 6 is a schematic sectional view showing the general construction of the sheet after-treatment device according to a second embodiment of the present invention.

FIG. 6 is a schematic sectional view showing the construction of the stapler unit H2 and its periphery. This stapler unit H2 is also equipped with a stapler main body 208, holders 251 and 252, a staple cartridge (not shown), etc. The holders 251 and 252 have sheet transport guide surfaces 253 and 254 formed integrally thereon. The sheet transport guide surfaces 253 and 254 serve to guide the entering sheet S to the opening 220 of the stapler main body 208.

The stapler main body 208, held by the holders 251 and 252, is arranged so as to be inclined to the sheet-transport upstream side by an angle θ with respect to the vertical direction. That is, the stapler unit H2 is inclined such that it is lower on the upstream side with respect to the sheet transport direction.

The relationship between the height of a transport path surface 255 on the upstream side of the stapler unit H2 with respect to the transport direction and the height of the side wall 252*a* of the holder 252 on the sheet entrance side (the height of the sheet transport guide surface 254) is determined as follows: Assuming that (the height of the transport path surface 255)−(the height of the side wall 252*a* of the holder 252 on the sheet entrance side)=T2, T2 is not less than 0.

The configuration of the lower holder 252 is determined as follows: Assuming that (the height of the side wall 252*a* of the holder 252 on the sheet entrance side (the height of the sheet transport guide surface 254))−(the height of the upper surface 210*a* of the lower jaw 210 of the stapler main body 208)=T3, T3 is not less than 0. The dimension T3 is approximately 0.5 mm, which substantially corresponds to the thickness of a staple. In FIG. 6, the step T3 is exaggerated for the purpose of clarity.

Further, the relationship between the height of the side wall 252*b* of the holder 252 on the sheet discharging direction and the height of the upper surface 210*a* of the lower jaw 210 of the stapler main body 208 is determined as follows: Assuming that (the height of the upper surface 210*a* of the lower jaw 210 of the stapler main body 208)−(the height of the upper end 252*ba* of the side wall 252*a* of the holder 252 on the sheet discharging direction)=T4, T4 is not less than 0.

In this way, in this sheet after-treatment device 250, the following are to be ranked in height as follows in descending order: e.g. the transport path surface 255 constituting the sheet guide portion, e.g. the sheet transport guide surface 254 constituting the upstream side upper end of the holding means, the upper surface 210*a* of the lower jaw 210, and the upper end 252*ba* of the side wall 252*a*, which constitutes the downstream side portion of the holding means.

Between the stapler main body 208 and the upstream side of the holders 251 and 252 with respect to the sheet transport direction, there is formed a first gap 216, which is wider than the thickness of the staple. This first gap 216 is capable of recovering ineffective staples falling therein. The dimension of the first gap 216 is approximately 0.5 mm or more. It is not absolutely necessary for this first gap 216 to be formed between the stapler main body 208 and the holder 251.

Between the downstream side of the transport path surface 255 and the stapler unit H2, there is formed a second gap 217, which is also wider than the thickness of the staple. This second gap 217 recovers any ineffective staples the first gap 216 has failed to recover.

Further, between the stapler main body 208 and the downstream side of the holders 251 and 252 with respect to the sheet transport direction, there is formed a third gap 219, which is wider than the thickness of the staple. This third gap 219 is also capable of recovering ineffective staples falling therein. The dimension of the third gap 219 is approximately 0.5 mm or more. It is not always necessary to form this third gap 219 between the stapler main body 208 and the holder 251.

Sheet After-Treatment Device of the Third Embodiment

Next, a sheet after-treatment device according to the third embodiment will be described. The sheet after-treatment device of the third embodiment differs from that of the first embodiment in the configuration of a stapler unit H3. Thus, the following description given with reference to FIGS. 7A and 7B will be focused on the stapler unit H3, and a description of the rest of the embodiment will be omitted.

Figure 7B:
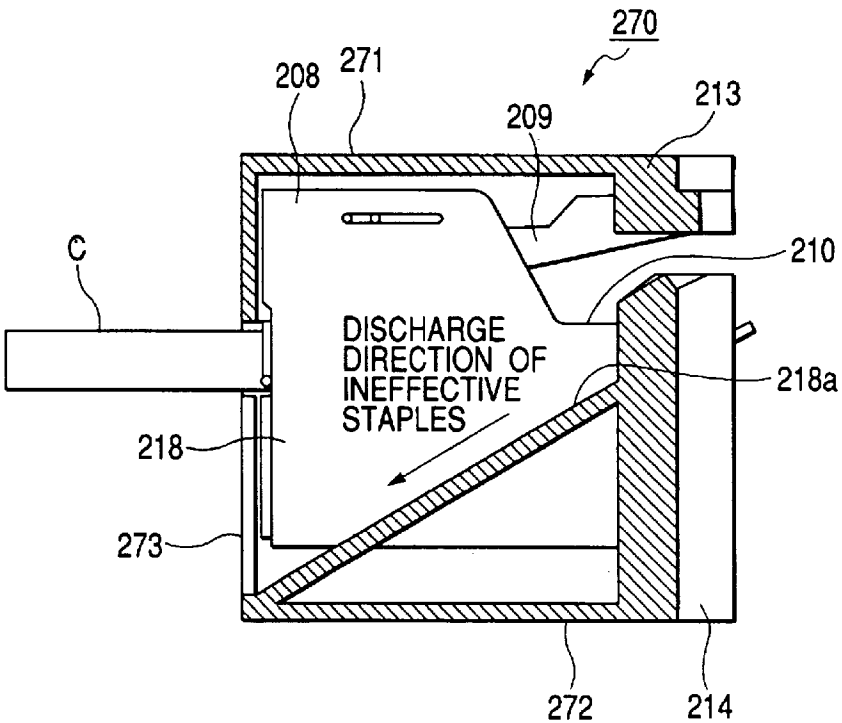
FIG. 7B is a sectional view taken along the line VIIB—VIIB of FIG. 7A.
Figure 7A:
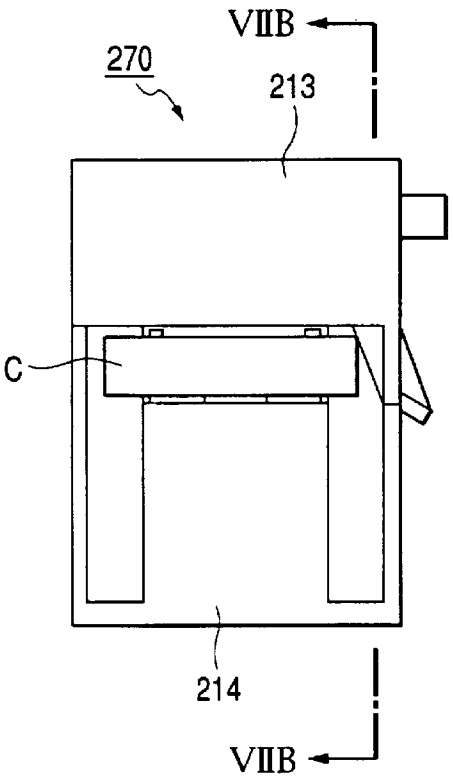
FIG. 7A is a front view of a stapler unit in a sheet after-treatment device according to a third embodiment of the present invention.
Figure 8:
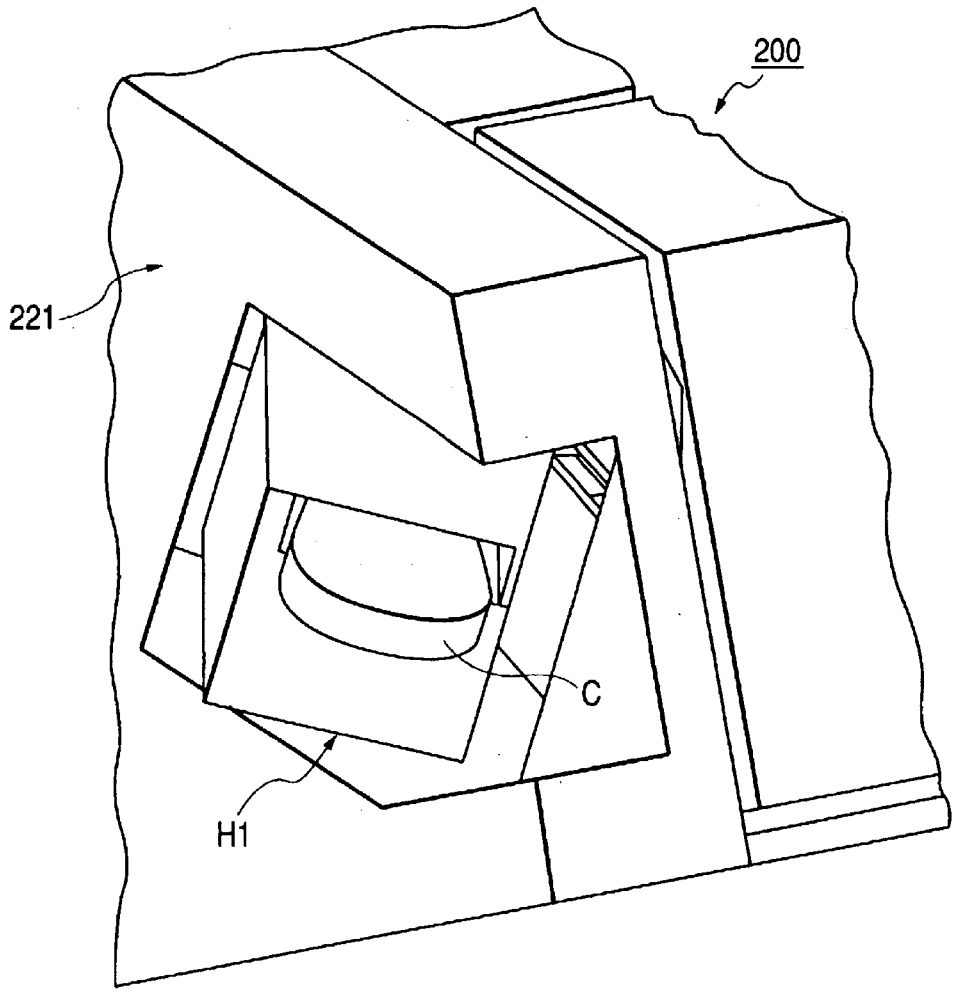
FIG. 8 is a perspective view of the stapler unit of the first embodiment of the present invention.
Figure 9:
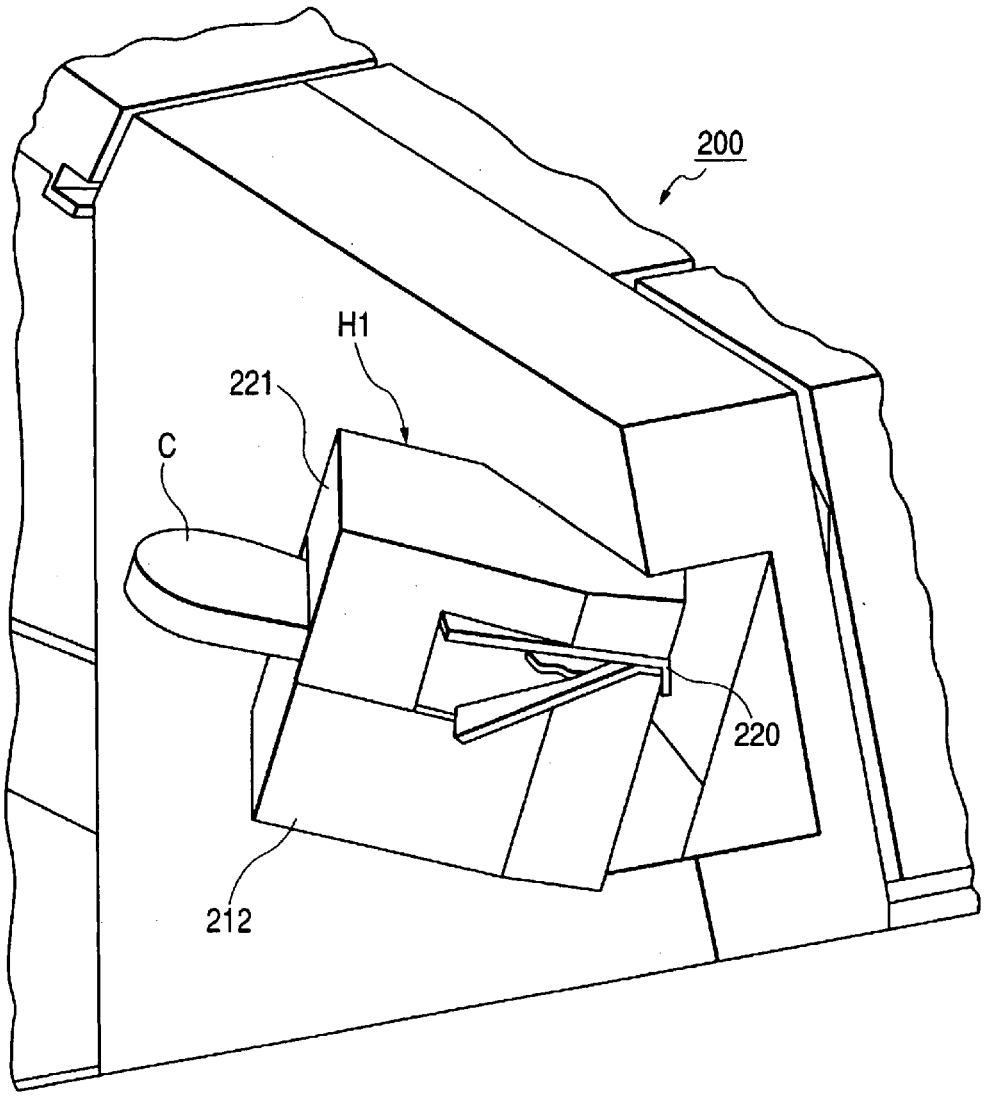
FIG. 9 is a diagram showing the stapler unit of FIG. 8 as rotated until the opening of the stapler main body is exposed.
Figure 10:
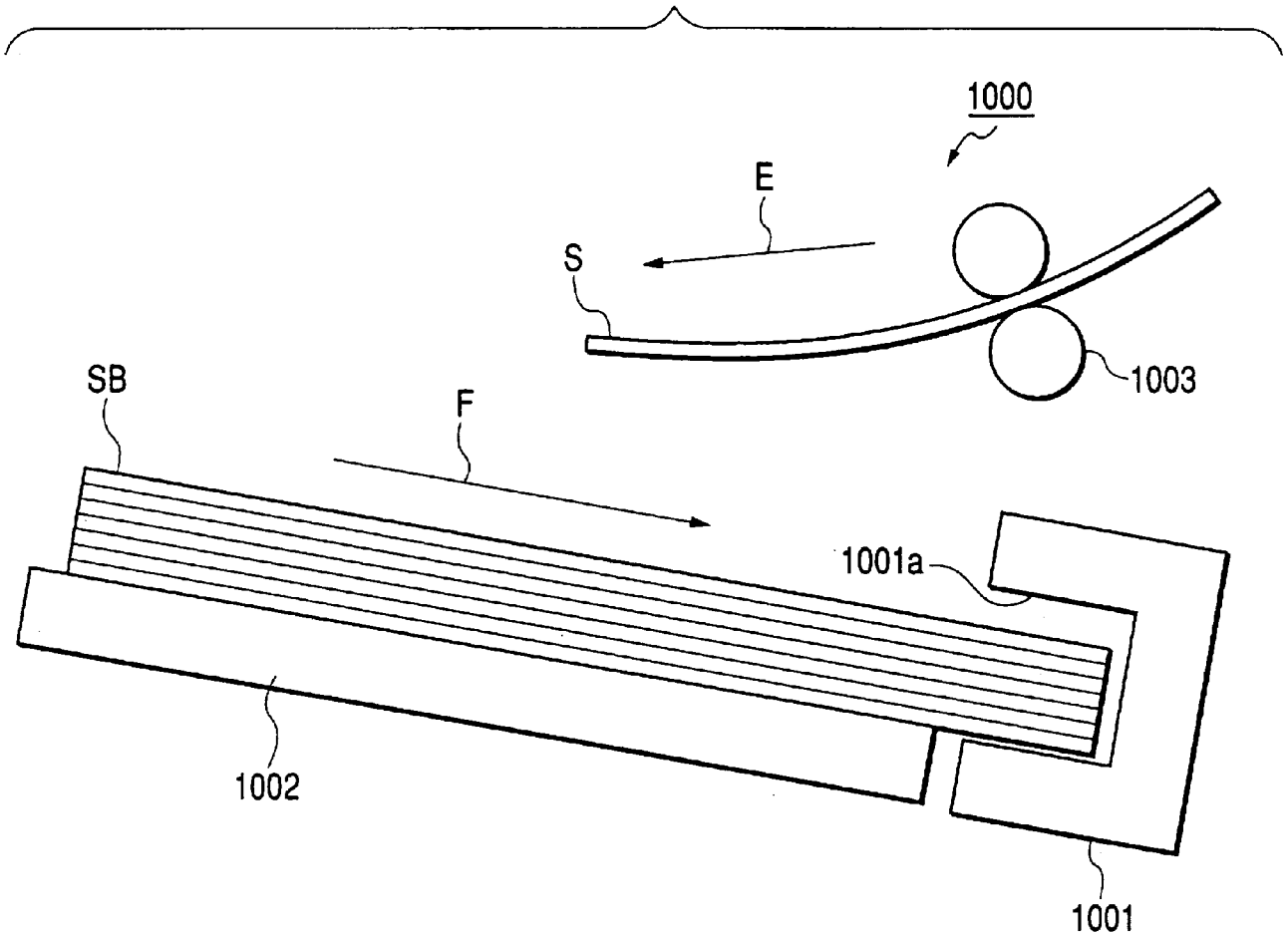
FIG. 10 is a schematic diagram showing a conventional sheet after-treatment device.

FIGS. 7A and 7B are schematic diagrams showing the construction of the stapler unit H3. This stapler unit H3 is also equipped with box-like holders 271 and 272, a staple cartridge C, etc. Provided between the stapler main body 208 and e.g. the holder 272 serving as the holding means is a fourth gap 218 corresponding to the gaps 216 and 219 of the stapler unit H2 in the sheet after-treatment device of the second embodiment. FIG. 7B shows the fourth gap corresponding to the gap 216. The width of the fourth gap 218 is also larger than the thickness of the staple. And, formed in this fourth gap 218 is an inclined surface 218*a* serving as a guide surface. A holder 272 at the lower end of the inclined surface 218*a* has a discharge outlet 273 for discharging ineffective staples.

Thus, ineffective staples falling in the fourth gap 218 slide down on the inclined surface 218*a* of the fourth gap 218, and are discharged to the exterior through the discharge outlet 273. The discharge outlet 273 is formed at a position where electrical components are not arranged. When there is an electrical component below the discharge outlet 273, it is desirable to provide the discharge outlet with a detachable cover.

Like the stapler units H1 and H2, the stapler unit H3 may be inclined to the upstream side with respect to the sheet transport direction by an angle θ.

The stapler unit H1, H2, H3 is provided in the sheet after-treatment device main body 221 (See FIG. 1) so as to be capable of rotating from the downstream side to the upstream side with respect to the sheet transport direction to thereby expose the opening 220 of the stapler main body 208 to the exterior. The stapler unit H1 is provided in the sheet after-treatment device main body 221 by means of the support shafts 222 and 223 as shown in FIG. 2. Similarly, the stapler unit H2 is provided in the sheet after-treatment device main body 221 by means of the support shafts 224 and 225, as shown in FIG. 6. The support shafts of the stapler unit H3 are not shown. It is not always necessary for the stapler units H1, H2, and H3 to be rotatable. They may also be stationary.

The above-described sheet after-treatment device 200 of the first embodiment of the present invention is connected to the apparatus main body 301 of the printer 300 as a component of the printer 300, and has the stapler unit H1 for stapling a plurality of stacked sheets discharged from the apparatus main body 301, wherein the sheet-entrance-side side wall 212*a* defining an opening of the holders 211 and 212 holding, e.g., the stapler main body 208 serving as the stapling means is set to be higher than the upper surface 210*a* of the lower jaw of the stapler main body 208, so that there is no danger of the leading ends of the sheets colliding with the lower jaw 210 of the upper and lower jaws 209 and 210 forming the opening 220 of the stapler 208, whereby it is possible to arrange the opening 220 of the staple main body 208 in the sheet transport area SA.

In this way, there is no danger of the sheets colliding with the lower jaw 210, so that it is possible to transport the sheets smoothly. Further, unlike the conventional sheet after-treatment device 1010, this device does not require arrangement of the stapler unit H1 off the sheet transport area SA, and it is possible to arrange the opening 220 of the staple main body 208 in the sheet transport area SA. As a result, it is possible to reduce the distance through which the sheets are moved to reach the sheet stapling position, thereby making it possible to achieve a reduction in the size of the sheet after-treatment device 1010.

In the sheet after-treatment device of this embodiment, a staple is projected from the stationary, lower jaw 210 of the stapler unit H1, and the upper jaw 209 is moved toward and away from the lower jaw 210 to bend the staple, so that there is no need to raise the sheet stack for stapling, whereby it is possible to staple the sheet stack without disturbing the aligned state of the sheet stack.

Further, the side wall 212*a* on the sheet entrance side is higher than the upper surface 210*a* of the lower jaw 210 of the stapler main body 208, and the stapler unit H1 is set so as to be inclined to the sheet entrance side, whereby the pocket portion 215 is formed by the side wall 212*a* and the upper surface 210*a* of the lower jaw 210, making it possible to store ineffective staples resulting from mis-stapling instead of letting them fall outside the stapler unit H1. Thus, if no dedicated ineffective staple recovery tray or the like is provided, it is possible to avoid the danger of short-circuiting in the electrical components caused by effective staples falling thereon. Further, since there is no need to provide an ineffective staple recovery tray, it is possible to prevent an increase in size and cost. Further, it is possible to enhance the safety of the sheet after-treatment device.

In addition to the advantages also provided by the sheet after-treatment device of the first embodiment, the sheet after-treatment device of the second embodiment further provides the following advantages: Due to the formation of the first gap 216 between the stapler main body 208 and the holder 212 and to the inclination of the stapler unit H2, ineffective staples are guided by the first gap 216 as they fall and retained therein. Further, no ineffective staples remain on the upper surface 210*a* of the lower jaw 210 constituting the sheet passage surface of the stapler main body 208.

Thus, it is possible to prevent sheet jamming due to ineffective staples. Further, there is provided not only the first gap 216 but also the second gap 217, so that if the first gap 216 should fail to recover any ineffective staples, they can be recovered by the second gap 217. Further, the side wall or the like for checking ineffective staples becomes higher as it extends toward the upstream side with respect to the sheet transport direction, so that ineffective staples are easily received when they fall, whereby it is possible to achieve an improvement in terms of safety regarding ineffective staples, making it possible to achieve a high level of reliability.

In addition to the advantages as obtained with the sheet after-treatment devices of the first and second embodiments, the sheet after-treatment device of the third embodiment further provides the following advantage: The sheet after-treatment device is equipped with the gap 218 formed between the stapler main body 208 and the holder 272, and has the inclined surface 218*a* extending to the exterior, so that it is possible for ineffective staples to be guided by the inclined surface 218*a* leading to the exterior to be discharged to the exterior of the stapler unit H3. Thus, it is possible to remove ineffective staples as needed without rotating the stapler unit, thus minimizing the requisite action on the part of the user and improving the device in terms of maintainability.

Further, it is to be noted that since the stapler units in the sheet after-treatment devices of the first, second, and third embodiments are rotatable, the pocket portion 215 can be opened to the outside, and even if a large amount of ineffective staples are retained in the pocket portion 215, they can be removed easily. Further, it is also possible to prevent transport jamming or the like due to the ineffective staples.

What is claimed is:

1. A sheet after-treatment device comprising:

a stapler including an upper jaw and a lower jaw which staple sheets fed between said upper jaw and said lower jaw with a staple by a closing operation of said upper jaw and said lower jaw; and a holder which holds said stapler; and a staple storage pocket which stores staples resulting from mis-stapling of sheets by said staplers, wherein said staple storage pocket is formed in a step between said holder and said lower jaw.

2. A sheet after-treatment device according to claim 1, wherein said stapler overlaps a sheet transport area, and said staple storage pocket is formed in the step between said lower jaw and a guide surface of a sheet carry-in guide on said holder.

3. A sheet after-treatment device according to claim 2 wherein said stapler is inclined to be lowered on an upstream side in a sheet transport direction.

4. A sheet after-treatment device according to claim 2, further comprising an upstream guide which guides a sheet, said upstream side being provided at an upstream side of said holder in a sheet transport direction, wherein a guide surface of said upstream guide, said guide surface of said sheet carry-in guide, and said lower jaw are arranged to be decreased in height in order of the guide surface of said upstream guide, said guide surface of said sheet carry-in guide, and said lower jaw.

5. A sheet after-treatment device according to claim 1, said staple storage pocket is formed in a gap between said lower jaw and a side wall on an upstream side in a sheet transport direction of said holder.

6. A sheet after-treatment device according to claim 5, wherein said stapler is inclined to be lowered on the upstream side in the sheet transport direction.

7. A sheet after-treatment device according to claim 5, wherein said staple storage pocket includes an inclined staple guide communicating with a discharge outlet for discharging the staples to an outside of said holder.

8. A sheet after-treatment device according to claim 5, further comprising another staple storage pocket provided on a downstream side in the sheet transport direction of said stapler.

9. A sheet after-treatment device according to claim 8, wherein said another staple storage pocket includes an inclined staple guide communicating with a discharge outlet for discharging the staples to an outside of said holder.

10. A sheet after-treatment device according to claim 5, further comprising another staple storage pocket provided on the upstream side in the sheet transport direction of said holder.

11. A sheet after-treatment device according to claim 1, wherein said stapler is rotatably supported so that an opening formed between said upper jaw and said lower jaw is opened to an outside.

12. A sheet after-treatment device according to claim 1, wherein said lower jaw is fixed, and said upper jaw is movable toward and away from said lower jaw.

13. An image forming apparatus comprising:

an image forming portion which forms an image on a sheet; and a sheet after-treatment device which treats the sheet on which the image is formed by said image forming portion, said sheet after-treatment device including:

a stapler including an upper jaw and a lower jaw which staple sheets fed between said upper jaw and said lower jaw with a staple by a closing operation of said upper jaw and said lower jaw;

a holder which holds said stapler; and a staple storage pocket which stores staples resulting from mis- stapling of sheets by said stapler, wherein said staple storage pocket is formed in a step between said holder and said lower jaw.

14. An image forming apparatus according to claim 13, wherein said stapler overlaps a sheet transport area, and said staple storage pocket is formed in the step between said lower jaw and a guide surface of a sheet carry-in guide on said holder.

15. An image forming apparatus according to claim 14, wherein said stapler is inclined to be lowered on an upstream side in a sheet transport direction.

16. An image forming apparatus according to claim 14, further comprising an upstream guide which guides a sheet said upstream guide being provided at an upstream side of said holder in a sheet transport direction, wherein a guide surface of said upstream guide, said guide surface of said sheet carry-in guide, and said lower jaw are arranged to be decreased in height in order of the guide surface of said upstream guide, said guide surface of said sheet carry-in guide, and said lower jaw.

17. An image forming apparatus according to claim 13, said staple storage pocket is formed in a gap between said lower jaw and a side wall on an upstream side in a sheet transport direction of said holder.

18. An image forming apparatus according to claim 17, wherein said stapler is inclined to be lowered on the upstream side in the sheet transport direction.

19. An image forming apparatus according to claim 17, wherein said staple storage pocket includes an inclined staple guide communicating with a discharge outlet for discharging the staples to an outside of said holder.

20. An image forming apparatus according to claim 17, further comprising another staple storage pocket provided on a downstream side in the sheet transport direction of said stapler.

21. An image forming apparatus according to claim 20, wherein said another staple storage pocket includes an inclined staple guide communicating with a discharge outlet for discharging the staples to an outside of said holder.

22. An image forming apparatus according to claim 17, further comprising another staple storage pocket provided on the upstream side in the sheet transport direction of said holder.

23. An image forming apparatus according to claim 13, wherein said stapler is rotatably supported so that an opening formed between said upper jaw and said lower jaw is opened to an outside.

24. An image forming apparatus according to claim 13, wherein said lower jaw is fixed, and said upper jaw is movable toward and away from said lower jaw.

* * * * *

UNITED STATES PATENT AND TRADEMARK OFFICE

CERTIFICATE OF CORRECTION

PATENT NO. : 7,077,395 B2
APPLICATION NO. : 10/429786
DATED : July 18, 2006
INVENTOR(S) : Hironobu Ata et al.

It is certified that error appears in the above-identified patent and that said Letters Patent is hereby corrected as shown below:

ON THE TITLE PAGE

At Item (56), References Cited, Foreign Patent Documents, "09194121 A" should read --9-194121 A--, and "09278270 A" should read --9-278270 A--.

COLUMN 5

Line 44, "an" should read --a--.

COLUMN 11

Line 3, "retained" should read --are retained--;
Line 44, "and" (second occurrence) should be deleted;
Line 47, "staplers," should read --stapler,--; and
Line 56, "claim 2" should read --claim 2,--.

COLUMN 12

Line 2, "said" (first occurrence) should read --wherein said--;
Line 44, "mis- stapling" should read --mis-stapling--; and
Line 65, "said" (first occurrence) should read --wherein said--.

Signed and Sealed this

Thirtieth Day of January, 2007

JON W. DUDAS
*Director of the United States Patent and Trademark Office*